United States Patent [19]

Anderson

[11] 4,399,856

[45] Aug. 23, 1983

[54] ADJUSTABLE VALANCE SUSPENSION BRACKET

[75] Inventor: Richard N. Anderson, Owensboro, Ky.

[73] Assignee: Hunter Douglas, Inc., Totowa, N.J.

[21] Appl. No.: 296,974

[22] Filed: Aug. 27, 1981

[51] Int. Cl.[3] ..... E06B 9/00

[52] U.S. Cl. ..... 160/39

[58] Field of Search ..... 160/19, 38, 39, 345, 160/346; 16/94 D; 248/223.4, 224.1, 224.2

[56] References Cited

U.S. PATENT DOCUMENTS 3,346,227 10/1967 Hankin ..... 16/94 D 3,503,434 3/1970 Ford ..... 160/345

4,254,813 3/1981 Vecchiarelli ..... 160/39

*Primary Examiner*—Peter M. Caun

*Attorney, Agent, or Firm*—Pennie & Edmonds

[57] ABSTRACT

An adjustable valance suspension bracket for connecting a valance to a headrail of a venetian blind assembly. The bracket comprises a base portion and a clip portion. The clip portion has thereon valance connection means for connecting to a valance while the base portion has fastening means to fasten with the headrail. The clip is held to the base in one position to support the ends of a valance and a further clip may be held to a further base in a further position to support the valance at a desired distance from the headrail.

10 Claims, 10 Drawing Figures

ADJUSTABLE VALANCE SUSPENSION BRACKET

TECHNICAL FIELD

This invention relates to an adjustable valance suspension bracket by which a valance of a venetian blind assembly may be adjustably positioned with respect to a venetian blind headrail.

BACKGROUND OF THE INVENTION

Often in venetian blind assemblies slats of different widths are used with the same headrail with the result that, in those instances where a narrower slat is used, any valance connected to the headrail may be considerably spaced from the slats. It is desirable from an aesthetic view that the valance be mounted on the headrail to minimize the space between the valance and the slats.

Further, it is desirable that the end of the valance be supported by and connected to the headrail in order to prevent the ends of the valance from drooping thus presenting an unattractive appearance. Any bracket means suspending a valance from a headrail should therefore provide for adjustment of the spacing between the valance and the headrail and should in addition provide a suspension for the ends of the valance. Further, in order to reduce the expense of manufacturing various parts and to reduce the need of a large inventory of separate parts, it is desirable that any adjustable bracket used for suspending a valance from a headrail should have a minimum of parts and comprise parts which may be produced economically by molding of a plastic material.

It is, therefore, an object of my invention to provide for an adjustable valance suspension bracket by which the spacing between a valance and a headrail may be conveniently adjusted, which may provide suspension from a headrail of the ends of the valance, and which will comprise a minimum of easily produced parts.

GENERAL DESCRIPTION OF THE INVENTION

Broadly, an adjustable valance suspension bracket constructed according to my invention comprises a combination of a base which may be installed along a headrail and a clip which fastens in one position to the base to support the end portions of a valance and which fastens in another position to the base to support and adjustably space intermediate portions of the valance. The base includes fastening means for fastening it along a headrail and a first dovetail extending parallel to the headrail which slidably engages with a second dovetail on the clip. The clip includes a valance connection means at one end for supporting an end of a valance when the first dovetail of the base engages the second dovetail of the clip.

The base in addition also has a third dovetail extending perpendicular to the first dovetail for slidably engaging with the second dovetail of a further clip similar in all respects to the first mentioned clip and where the valance connecting means connects with portions of the valance intermediate its ends.

The second dovetail of the clip and third dovetail of the base connect adjustable stops in order that the clip may be adjusted with respect to the base, and consequently the valance adjusted with respect to the headrail.

Preferably, the fastening means for the base comprises first and second barb means adapted to engage elongated recesses contained in the front and rear flanges of an inverted channel shaped headrail. The barb means allows the base to be snapped onto the headrail or to be slid over the ends of the headrail to any desired position along the length of that rail.

The base preferably is T-shaped and includes a stem connected at one end to a cross-piece. The base includes a secondary portion connected at one end of the stem and being spaced from and extending parallel to the cross-piece. The secondary portion may further include a protrusion thereon for engaging and locking the second dovetail of the clip with respect to the first dovetail of the base.

The base may also include a strengthening gusset extending progressively downwardly from one end of the stem towards and to the second barb means in order to engage a flange of the headrail. The end of the gusset adjacent the flange may include a break off portion in order that the base may be fastened to headrails of different sizes.

The clip has a vertical face at one end having a valance connecting means thereon in the form of a slot or a T-shaped projection for engaging either a T-shaped projection or slot on the valance. The clip also has a strengthening gusset extending progressively downwardly from an area adjacent the second dovetail towards and to the bottom of the vertical face.

The base and clip preferably are made of a plastic material and, because of their configurations, may be conveniently molded using uncomplicated molds thus reducing the cost of both the parts produced and tooling costs.

DESCRIPTION OF THE PREFERRED EMBODIMENTS

Figure 1:
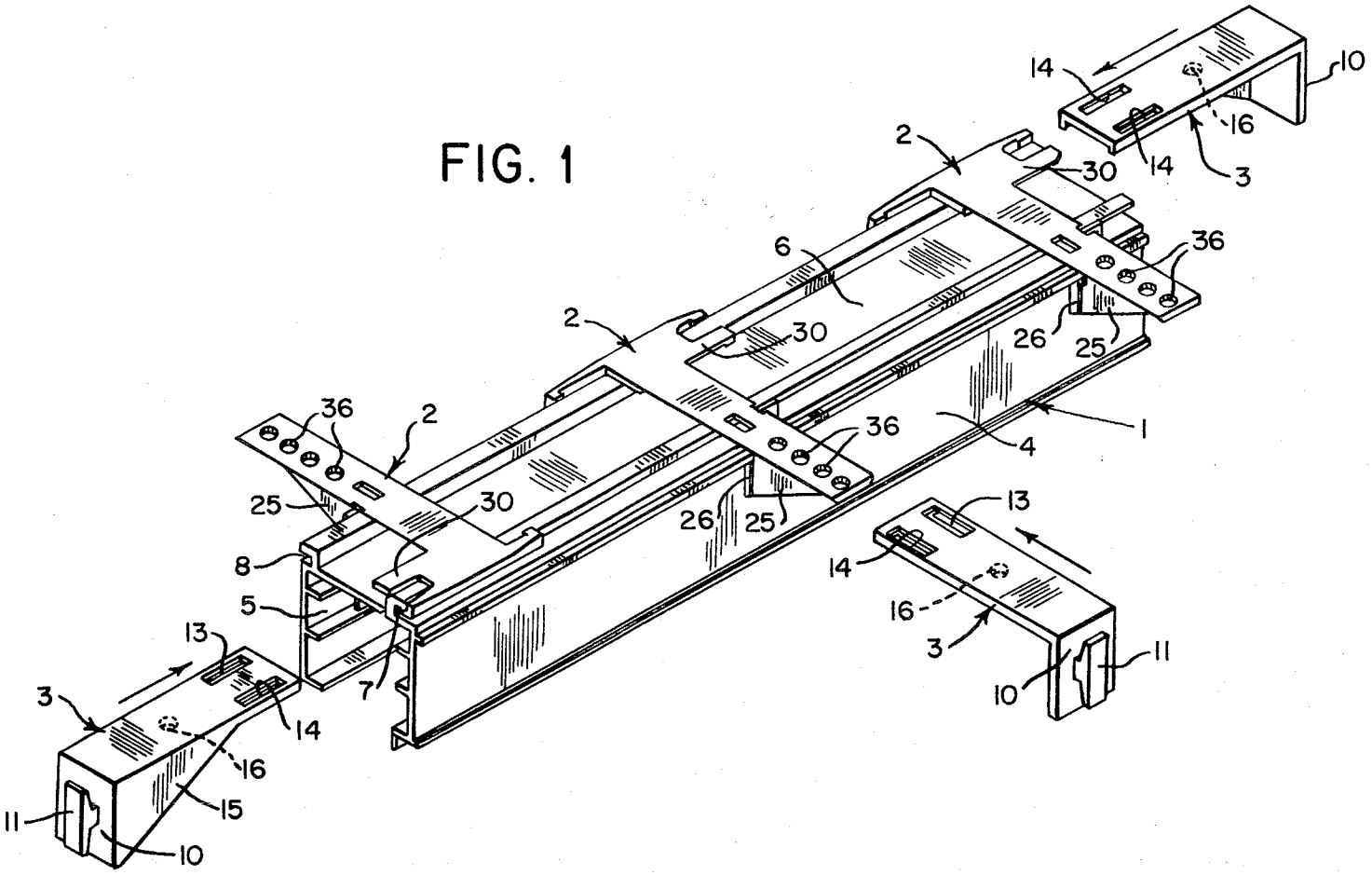
FIG. 1 is a perspective view of bases and clips as applied to a headrail to form adjustable valance suspension brackets constructed according to the invention.

Referring to FIG. 1, there is illustrated a headrail 1 having a plurality of bases 2 fastened thereon and to which clips 3 may be fastened. A clip and a base together form an adjustable valance suspension bracket according to the invention.

The headrail 1 on which the bases are fastened comprises an inverted channel cross-section having a front flange 4, a rear flange 5, and a web 6 joining the two flanges. Elongated recesses 7 and 8 are included in flanges 4 and 5 adjacent web 6.

The headrail illustrated is a conventional headrail used to mount vertically-extending slats of a venetian blind.

Figure 2:
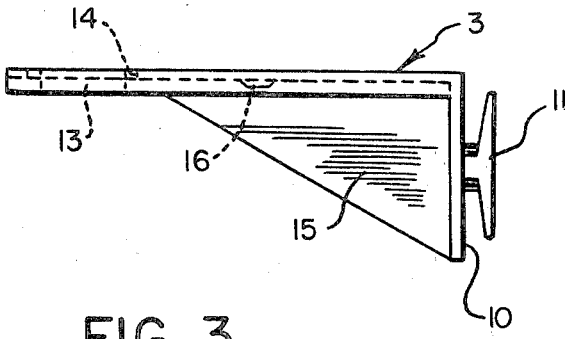
FIG. 2 is a side view of a clip as illustrated in FIG. 1.
Figure 3:
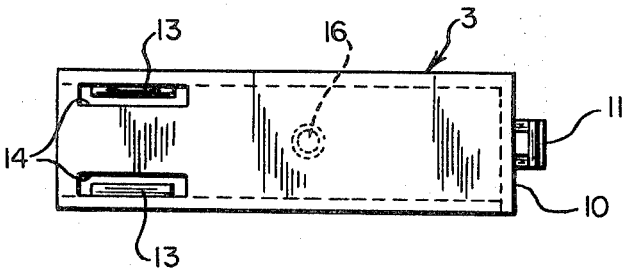
FIG. 3 is a plan view of a clip of FIG. 2.
Figure 4:
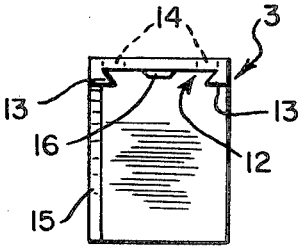
FIG. 4 is a left-end view of the clip of FIG. 3.

Referring to FIGS. 2–4, it is seen that the clip 3 has a vertical face 10 at one end thereof on which a valance suspension means 11 is mounted, and which in the embodiment of FIG. 2 has the form of a T-shaped projection.

The clip has a female dovetail construction 12 adjacent the end of the face 11, which, as explained in greater detail hereafter, is adapted to slidably engage male dovetails located on the base 2. The dovetail 12 is formed by two inturned lips 13 which extend partially along the clip. Cutouts 14 are included in the clip above the lips to increase flexibility of the lips so that they may easily engage with a male dovetail.

A gusset 15 extends progressively downwardly from an area adjacent the dovetail 12 to the bottom of the vertical face. The gusset strengthens the clip to prevent it from bending under the weight of a valance applied to the valance suspension means 11.

The clip also includes a raised button 16 on the bottom surface thereof adapted to engage holes in the base as explained hereafter such that the holes and button together act as an adjustable stop.

Referring to FIGS. 5–8, it is seen that the base 2 comprises a T-shaped body having a cross-piece 20 connected at one end of a stem 21. The base has a fastening means in the form of a first barb means 22 and a second barb means 23 for engaging the recesses 7 and 8 of the headrail. The base may be fastened to the headrail either by snapping the barbs down over the upper corners of the headrail until they engage in the recesses or sliding the base over an end of the headrail to a desired position along the length of the headrail. To increase flexibility of the barbs, the barbs 23 are formed near the end of the cross-piece 20 while the barb 22 is mounted on the end of an arm 24. While fastening means in the form of barbs are preferred, the fastening means could comprise any structure fastening the base to the headrail.

The base 2 is provided with a gusset 25 which extends downwardly progressively from an end of the stem 21 towards and adjacent to an area beneath the barb 22. This gusset serves to strengthen the base to assure that the stem 21 remains in a horizontal position under the weight of a valance. When the base is fastened to a headrail, the vertical end of the gusset will face a flange. In the event that a headrail of different dimensions is used, the gusset is provided with a break-off tab 26 which may be readily snapped off to accommodate headrails having flanges spaced further apart than that of the headrail illustrated in the drawings.

The stem 21 has a secondary portion 30 extending parallel to and spaced from the cross-piece 20. One side of the secondary portion has an undercut 31 while the outer end of the cross-piece has an undercut 32. Undercuts 31 and 32 together form a first male dovetail which may slidably engage with the female dovetail of a clip which for the purposes of this description is referred to as a second dovetail. A projection is included on the secondary portion 30 and engages the end of a female dovetail when a clip is positioned on the base to lock the female dovetail in place.

The stem 21 is provided with undercuts 34 and 35 to form the third male dovetail for slidingly engaging the female dovetail of the clip. The stem may be provided with a plurality of holes 36 into which a button 16 of the clip may extend to provide an adjustable stop and by which the clip may be adjustably positioned with respect to the base.

Figure 9:
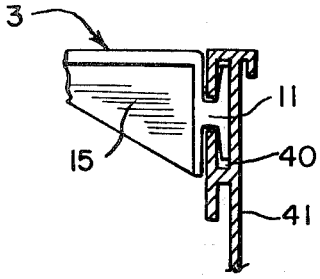
FIG. 9 is a view of a portion of the clip as shown in FIG. 2 engaging a valance.

Referring to FIG. 9, the T-shaped valance connecting means 11 is shown engaging a slot 40 of a valance 41.

Figure 10:
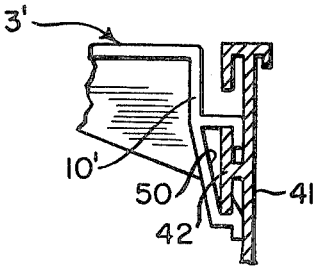
FIG. 10 is a view similar to FIG. 9 illustrating a clip having a further embodiment of a valance connecting means.
Figure 5:
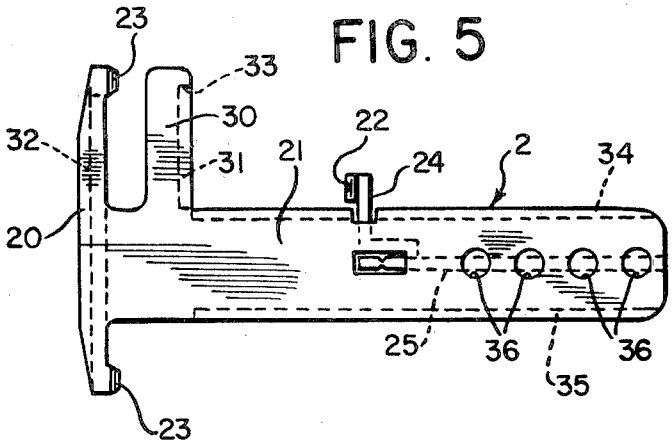
FIG. 5 is a plan view of a base as illustrated in FIG. 1.
Figure 6:
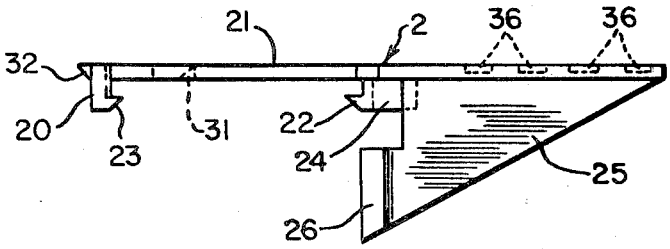
FIG. 6 is a side view of the base of FIG. 5.
Figure 7:
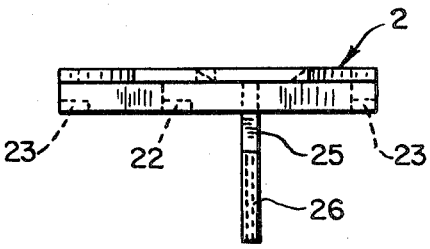
FIG. 7 is a left-end view of the base of FIG. 6.
Figure 8:
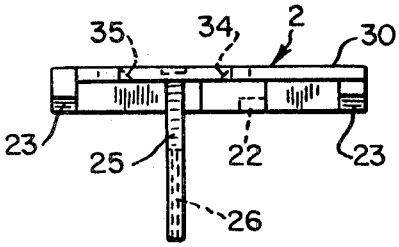
FIG. 8 is a right-end view of the base of FIG. 6.

A further embodiment of a valance connecting means is illustrated in FIG. 10 where the clip 3' has a slot 50 on a vertical base 10' engaging a T-shaped projection 42 on the valance 41.

The bases and clips are assembled into a headrail as follows. Bases 2 for supporting intermediate portions of a valance are snapped onto the headrail or slid over the end portions of the headrail to the positions desired and such that the vertical end of the gussets 25 face a front flange 4 of the headrail. One base 2 is positioned at the end of the headrail such that it faces in the same direction as the bases used for supporting intermediate portions of the valance. At the opposite end of a headrail (the left end as shown in FIG. 1), a base is positioned on the end of the headrail to face in the opposite direction than the other bases. This is so that the first dovetail on this particular base will face outwardly of the end of the headrail allowing the dovetail of the clip to slide in place thereon.

Clips 3 are then slid over the bases at the end of the headrail so that the female dovetails of the clips engage the first male dovetails of the bases, and until the projections 33 snap into place behind the ends of the female dovetails at which point the clips are locked into place.

Clips are applied to the bases located intermediate the ends of the headrail by sliding the female dovetail of each clip over the third male dovetail of a base until the button 16 snaps into place in a hole 36 giving the desired adjustment or spacing of a valance from slats carried by the headrail. There is sufficient flexibility in the parts so that the clip 3 may be bent up slightly to allow the button 16 to pass over the top of the stem. The weight of the valance when in place tends to keep the button engaged within the selected hole.

A further male dovetail could be provided on the stem of the base to extend parallel to the first dovetail and to accommodate the female dovetail of a clip such that it would not be necessary to reverse the left-hand clip shown in FIG. 1. This construction, however, would result in an increase of material of the base and a more involved mold thus increasing material cost of the base as well as increasing tooling cost.

It is seen that an adjustable valance suspension bracket as described comprises a minimum number of parts while providing an adjustable support for adjusting spacing between a valance and a headrail and, at the same time, providing a support for the end portions of a valance.

I claim:

1. An adjustable valance suspension bracket for suspending a valance from a headrail of an inverted channel cross-section having front and rear flanges joined by an upper web, said flanges having adjacent the web elongated recesses extending the length of the headrail, characterized in that said bracket has:

(i) a base including,
  (a) fastening means for fastening said base along said headrail,
  (b) a first dovetail on said base extending parallel to the headrail, and
  (c) a third dovetail extending perpendicular to said first dovetail, and;

(ii) a clip including,
  (a) a second dovetail for slidably engaging either of said first dovetail or said second dovetail, and (b) valance connection means on the end of said clip for supporting a valance.

2. An adjustable valance suspension bracket according to claim 1 further characterized in that said base has a first locking means thereon and said clip has a second locking means thereon cooperating with said first locking means for locking said clip from sliding movement with respect to said base when said third dovetail of the base engages the second dovetail of the clip whereby a valance supported by said clip may be adjustably positioned with respect to said headrail.

3. An adjustable valance suspension bracket according to claim 1 further characterized in that said base is generally T-shaped having a cross-piece extending parallel to the recesses in said headrail connecting with an end of a stem extending perpendicular to said cross-piece, in that said fastening means comprises a first barb means extending downwardly from the bottom surface of said cross-piece to engage one recess of the headrail and a second barb means extending downwardly from the bottom surface of said stem to engage a further recess of said headrail, and in that said stem has a secondary portion spaced from and extending parallel to said cross-piece with said cross-piece and said secondary portion including said first dovetail.

4. An adjustable valance suspension bracket according to claim 3 further characterized in that said secondary portion has a protrusion thereon for engaging and locking with the second dovetail of the clip when said second dovetail has been slid into engagement with said first dovetail.

5. An adjustable valance suspension bracket according to claim 4 further characterized in that said first dovetail is male and the second dovetail is female.

6. An adjustable valance suspension bracket according to claim 3 further characterized in that said stem has a gusset extending progressively downwardly from the end of the stem opposite said cross-piece towards and to said second barb means with the end of the gusset adjacent the second barb means facing a flange of the headrail.

7. An adjustable valance suspension bracket according to claim 6 where the end of the gusset adjacent the second barb means comprises a break-off tab to accommodate headrails having different dimensions.

8. An adjustable valance suspension bracket according to claim 1 further characterized in that said clip includes a vertical face mounting said valance connecting means and in that a gusset extends progressively downwardly from an area adjacent said second dovetail towards and to the bottom of said vertical base.

9. An adjustable valance suspension bracket according to claim 8 further characterized in that said valance connecting means comprises a T-shaped projection for engaging a slot in a valance.

10. An adjustable valance suspension bracket according to claim 8 further characterized in that said valance connecting means comprises a slot for engaging a T-shaped projection on a valance.

* * * * *